US007360863B2

(12) United States Patent
Ballard et al.

(10) Patent No.: US 7,360,863 B2
(45) Date of Patent: Apr. 22, 2008

(54) PRINTING APPARATUS WITH A PRIMING DEVICE

(75) Inventors: Zachary Ballard, Avda Graells (ES); Pere Esterri, Sant Cugat del Valles (ES); Ramon Vega, Sabadell (ES); Xavier Bruch, Sant Cugat (ES); Alejandro Campillo, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 404 days.

(21) Appl. No.: 11/154,563

(22) Filed: Jun. 17, 2005

(65) Prior Publication Data

US 2006/0284926 A1 Dec. 21, 2006

(51) Int. Cl.
*B41J 2/165* (2006.01)

(52) U.S. Cl. ..... 347/30; 347/29; 347/32

(58) Field of Classification Search ..... 347/22, 347/29, 30, 32
See application file for complete search history.

(56) References Cited

U.S. PATENT DOCUMENTS 5,420,619 A * 5/1995 Glassett et al. ..... 347/30

* cited by examiner

*Primary Examiner*—Shih-Wen Hsieh

(57) ABSTRACT

The printing apparatus comprises at least one printhead provided with nozzles for ejecting droplets of ink in a firing direction towards a printing media, and at least one priming device for performing a priming operation by which an amount of ink is caused to flow through the nozzles for maintenance thereof, wherein the priming device is actuated for said priming operation by a relative movement between the printhead being primed and the priming device, said movement being substantially in said firing direction.

17 Claims, 1 Drawing Sheet

PRINTING APPARATUS WITH A PRIMING DEVICE

FIELD OF THE INVENTION

The present invention relates to a printing apparatus comprising at least one printhead provided with nozzles for ejecting droplets of ink on a printing media, and at least one priming device; the invention also relates to a priming device, and to a method for priming a printhead of a printing device.

BACKGROUND OF THE INVENTION

An inkjet printing apparatus is provided with one or more pens or printheads, containing and/or attached to an ink supply; each printhead has a firing chamber from which drops of ink are ejected through a plurality of nozzles towards a printing media, such as paper, in order to form a desired image.

The drops of ink may be ejected from a printhead by several means, e.g. providing a transducer to discharge the ink droplets from the nozzles. This could be done by thermal ink jet technology, or any other.

Amongst other maintenance operations, occasionally it is necessary to prime a printhead by creating a pressure differential that forces an amount of ink from the ink supply through the nozzles.

Priming may be necessary for maintaining or recovering satisfactory operation of the printhead, e.g. for removing ink that has dried on the printhead, or for unclogging or unblocking the nozzles if clogging has occurred; the need for a priming operation is more important with inks having a high concentration of solids, since they tend to clog more easily the printhead nozzles, e.g. pigmented inks.

Priming may be effected by causing the pressure to fall downstream of the nozzles, thus suctioning ink from the ink supply and through the nozzles, or by applying a positive pressure within the ink supply line, e.g. using some kind of pump upstream of the printhead, thus forcing ink through the nozzles.

Known priming methods generally involve the use of devices such as a peristaltic pump, as in U.S. Pat. No. 6,024,433, or a diaphragm driven by a cam, such as described in commonly owned U.S. Pat. No. 5,714,991, or a pump system driven by the horizontal movement of the printer carriage and a manifold system to arrive to each pen, or others. Another priming mechanism is described in commonly owned U.S. Pat. No. 6,419,343. All these solutions are relatively complex and expensive.

Still another known method includes a manually activated system with a bellows; such a solution requires user intervention and depends partly on the skill of the person performing the operation.

SUMMARY OF THE INVENTION

The present invention seeks to provide a printing apparatus with a priming device which is simple in construction and therefore has a relatively low cost, and which at the same time does not require user intervention for performing the priming operation.

According to a first aspect, the present invention relates to a printing apparatus comprising at least one printhead provided with nozzles for ejecting droplets of ink in a firing direction towards a printing media, and at least one priming device for performing a priming operation by which an amount of ink is caused to flow through the nozzles for maintenance thereof, wherein the priming device is actuated for said priming operation by a relative movement between the printhead being primed and the priming device, said movement being substantially in said firing direction.

By virtue of these features the priming system can be simple and have a relatively low cost.

In some embodiments of the invention the relative movement is a reciprocating vertical movement of the printhead, which may be a height adjustment movement of the type used in the prior art for adjusting the pen-to-paper spacing.

By using the printhead height adjustment movement to operate the priming device, a very simple priming system with few parts and a relatively low cost can be implemented.

According to another aspect, the invention relates to a printing apparatus comprising at least one printhead provided with nozzles for ejecting droplets of ink in a firing direction towards a printing media, and at least a mechanically-actuated priming bellows for performing a priming operation by which an amount of ink is caused to flow through the nozzles for maintenance thereof, wherein the bellows is actuated for said priming operation by a movement of the printhead being primed, and wherein said movement is substantially in said firing direction.

According to a further aspect, the invention provides a printing apparatus comprising at least one printhead provided with nozzles for ejecting droplets of ink on a printing media, and at least one priming device for performing a priming operation by which an amount of ink is caused to flow through the nozzles for maintenance thereof, wherein the priming device is actuated for said priming operation by a vertical height-adjustment movement of the printhead being primed.

The invention also relates to a priming device for performing on a printhead a priming operation by which an amount of ink is caused to flow through the printhead nozzles for maintenance thereof, wherein the priming device is adapted to be actuated for the priming operation by a relative movement between the printhead being primed and the priming device, said movement being substantially in a printhead firing direction.

According to still another aspect, the invention relates to a method for priming a printhead of a printing device that ejects droplets of ink in a firing direction towards a printing media, comprising the steps of:

providing a priming device;

bringing a printhead to be primed in engagement with said priming device; and causing a movement of the printhead substantially in the firing direction, to actuate the priming device.

BRIEF DESCRIPTION OF THE DRAWINGS

Particular embodiments of the present invention will be described in the following, only by way of non-limiting example, with reference to the appended drawings, in which.

DETAILED DESCRIPTION OF THE PREFERRED EMBODIMENTS

A printing apparatus such as an inkjet printer may be provided with several printheads, each having a nozzle plate with a plurality of nozzles for ejecting ink drops in a firing direction onto a print media; generally the media is horizontal in the print zone and the printhead is arranged over the media, such that the firing direction is vertical. In most inkjet printers the printheads are mounted on a carriage that can reciprocate along a scan axis of the printer. Such a structure is described e.g. in U.S. Pat. No. 6,419,343, which is incorporated herein by reference.

The carriage may also be able to perform a vertical height adjustment movement, i.e. a movement in the firing direction, normally in order to vary the gap between the printheads and the media being printed; this may be convenient e.g. to adapt the height of the printheads to different thicknesses of media maintaining an optimum printing quality.

Such a vertical movement of the carriage may be performed in a number of different manners; examples can be found in U.S. Pat. No. 6,705,693 and U.S. Pat. No. 6,629,787, both incorporated herein by reference, which describe two different mechanisms for this purpose; however, any other system is possible.

According to an embodiment of the invention, a printing apparatus is provided with a priming device which is actuated for a priming operation of the printhead nozzles by such a vertical movement of the printhead carriage.

Figure 1:
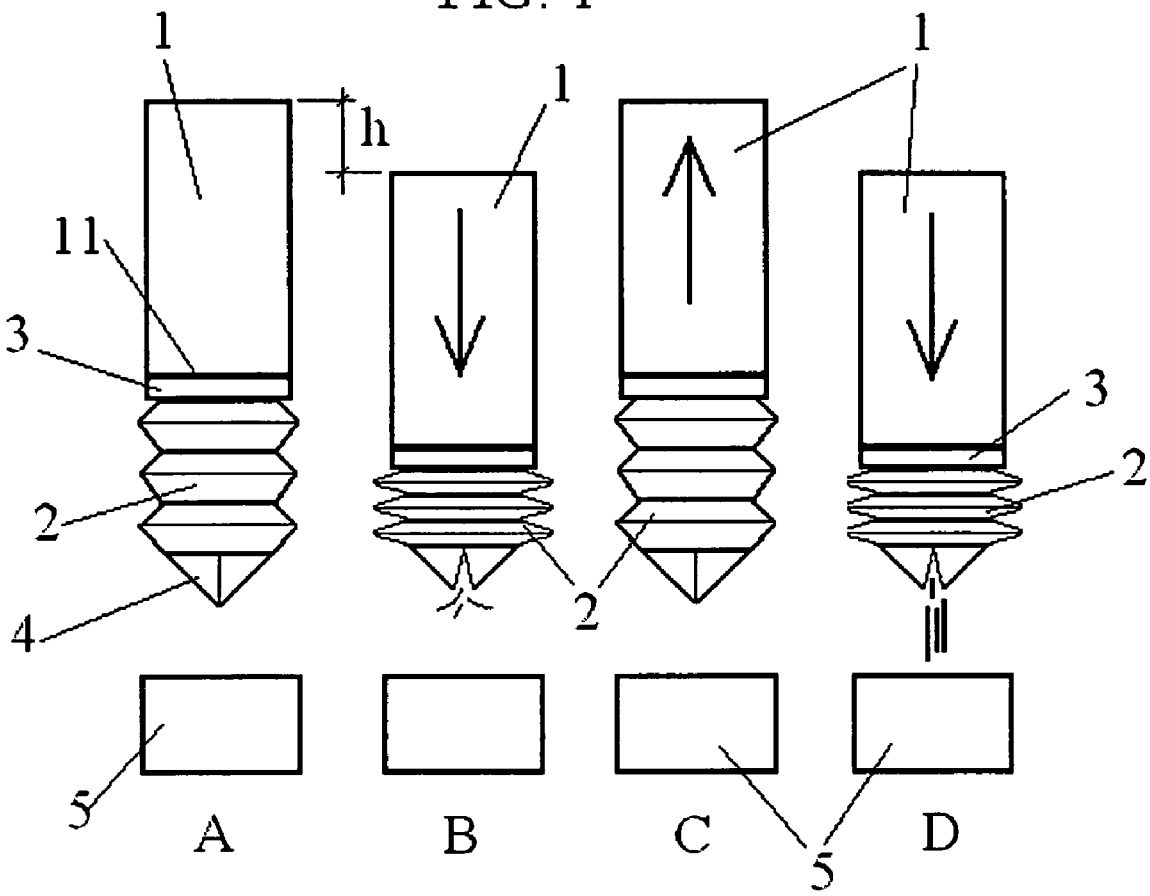
FIG. 1 shows a detail of a printing apparatus according to a first embodiment of the invention, in different positions during a priming operation.

FIG. 1, which shows four different positions A, B, C and D of a priming operation in which a printhead 1 having a plurality of nozzles on a nozzle plate 11 is being primed by means of a priming device comprising a bellows 2.

The bellows 2 may be stationary in the printing apparatus, for example in a position close to the service station, or it may be arranged on the service station itself.

The printhead carriage may be displaced to a position that brings into engagement the printhead 1 to be primed with the bellows 2; in the embodiment of FIG. 1 the printhead 1 is brought over the bellows 2, such that the bellows is connected to the printhead downstream of the nozzle plate 11.

Between the bellows 2 and the printhead nozzle plate 11, and associated with the bellows, there is a capping member 3 which has the function of providing seating engagement between the bellows and the nozzle plate 11 of the printhead 1. The capping member 3 may be like the seating caps described in U.S. Pat. No. 5,714,991 cited above, but also of any other suitable type.

At the other end of the bellows is provided a check valve 4, for example a duck-bill valve.

A priming operation performed with this arrangement is described in the following.

In the first place, the printhead is brought into contact with bellows 2 as shown in position A of FIG. 1, and the capping member is engaged with the nozzle plate 11 of the printhead. In this position the bellows is fully expanded, since there are no forces acting on it.

The printhead 1 is then moved downwards a distance h to position B; during this movement, the bellows 2 is compressed and the check valve 4 opens allowing the escape of air from the bellows.

Distance h corresponds to the maximum possible height adjustment the printhead carriage can perform; this distance can be, for example, about 2 mm.

In the next step (position C) the printhead is raised again, such that the bellows 2 expands. During this expansion, and since the presence of the check valve 4 prevents the entrance of air from the outside, the bellows draws ink by suction from the ink supply inside the printhead 1: a relatively large amount of ink flows through the nozzles clearing potential clogging and restoring proper functioning thereof.

The ink flows through the bellows 2, and is ejected towards a waste deposit 5 during the next step of the priming operation, when the printhead is again displaced downwards, to position D of FIG. 1. During this movement the check valve 4 opens allowing the ink drawn through the nozzles in the previous step to be expelled.

The process may be repeated, i.e. the printhead may be displaced downwards and upwards a number of times in order to increase the intensity of the priming operation and the flow of ink through the nozzles.

A layer of foam material may be provided in the capping member 3 or in a position along the bellows 2, in order to wick the ink away.

Bellows 2 has typically an accordion shape and is formed from a resilient material; however, any other type of bellows may be used.

Other types of priming devices different from a bellows may also be employed.

Figure 2:
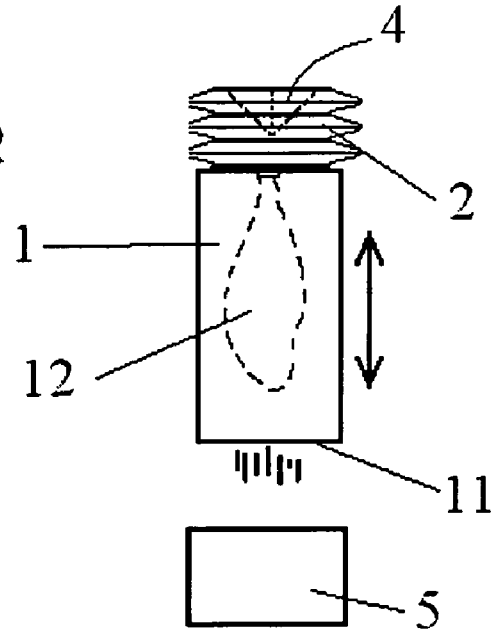
FIG. 2 shows the arrangement of the priming device according to an alternative embodiment of the invention.

FIG. 2 shows an alternative embodiment in which the printhead 1 to be primed is brought into engagement with a bellows 2 such that the bellows is placed above the printhead, and it is connected to a flexible air bag 12, in dotted lines in FIG. 2, which is provided inside the printhead 1.

Such a flexible bag is known in the prior art and functions in combination with a system of valves and levers (not shown) for the purpose of maintaining a substantially constant pressure differential between the ambient pressure and the pressure within the printhead ink chamber. It has also been used in prior art priming devices for the priming operation, such as disclosed in commonly owned U.S. Pat. No. 6,419,343 cited above. This document, which is incorporated herein by reference, may be consulted for a more complete description of a printhead having such a flexible bag and its operation.

In the embodiment of FIG. 2 the bellows is connected to a vent in the upper part of the printhead 1, which in turn is connected to the flexible bag 12, and a check valve 4 is arranged at the upper end of the bellows 2.

The printhead 1 is actuated with a reciprocating vertical movement, like in FIG. 1; the movement of the printhead causes the bellows 2 to compress and expand, such that it forces air into the flexible bag 12; as a consequence, an amount of ink is forced through the nozzles and a priming operation of the printhead is performed.

It can be noted that vertical printhead movement is only one possible way of actuating the priming device; and also that when this movement is used, the vertical travel of the printhead may need to be increased, depending on the system.

The invention claimed is:

1. A printing apparatus comprising at least one printhead provided with nozzles for ejecting droplets of ink in a firing direction towards a printing media, and at least one priming device for performing a priming operation by which an amount of ink is caused to flow through the nozzles for maintenance thereof, wherein the priming device is actuated for said priming operation by a relative movement between the printhead being primed and the priming device, said movement being substantially in said firing directions, wherein the priming device comprises a bellows, and wherein the priming device further comprises a check valve arranged at an opposite end of the bellows to that engaging the printhead.

2. A printing apparatus as claimed in claim 1, wherein the relative movement between the printhead and the priming device is a reciprocating vertical movement.

3. A printing apparatus as claimed in claim 1, wherein the relative movement of the printhead is a movement of the printhead.

4. A printing apparatus as claimed in claim 3, wherein the movement of the printhead is a height adjustment movement.

5. A printing apparatus as claimed in claim 3, wherein the printhead is mounted on a printhead carriage for displacement along a scan axis, and wherein the movement of the printhead actuating the priming device is a movement of said printhead carriage.

6. A printing apparatus as claimed in claim 1, wherein the priming device further comprises means for seating engagement of one end of the bellows to the printhead.

7. A printing apparatus as claimed in claim 6, wherein said means for sealing engagement of the bellows to the printhead comprise a nozzle capping member.

8. A printing apparatus as claimed in claim 1, wherein the priming device engages the printhead downstream of the nozzles and causes an amount of ink to flow through the nozzles by suction.

9. A printing apparatus comprising at least one printhead provided with nozzles at a first end thereof for ejecting droplets of ink in a firing direction towards a printing media, and at least one priming device for performing a priming operation by which an amount of ink is caused to flow through the nozzles for maintenance thereof, wherein the priming device is actuated for said priming operation by a relative movement between the printhead being primed and the priming device, said movement being substantially in said firing direction, wherein the printhead contains ink to be used for printing, and wherein the priming device is brought into connection with the printhead at a second end of the printhead furthest away from the printing media, and operates to cause an amount of the ink to be used for printing to flow through the nozzles by raising the pressure in the printhead.

10. A printing apparatus as claimed in claim 9, wherein the printhead includes a flexible bag for maintaining a substantially constant pressure differential within the printhead, wherein the printhead includes a vent provided on the second end of the printhead, in which the priming device makes contact with the vent to thereby cause air to be forced into the flexible bag.

11. A printing apparatus as claimed in claim 10, wherein the priming device comprises a bellows.

12. A printing apparatus comprising at least one printhead provided with nozzles for ejecting droplets of ink in a firing direction towards a printing media, and at least a mechanically-actuated priming bellows for performing a priming operation by which an amount of ink is caused to flow through the nozzles for maintenance thereof, wherein the bellows is actuated for said priming operation by a movement of the printhead being primed, and wherein said movement is substantially in said firing direction.

13. A printing apparatus comprising at least one printhead provided with nozzles for ejecting droplets of ink on a printing media, and at least one priming device for performing a priming operation by which an amount of ink is caused to flow through the nozzles for maintenance thereof, wherein the priming device is actuated for said priming operation by a vertical height-adjustment movement of the printhead being primed.

14. A method for priming a printhead of a printing device that ejects droplets of ink in a firing direction towards a printing media, comprising the steps of:

providing a priming device;

bringing a printhead to be primed in engagement with said priming device; and causing a movement of the printhead substantially in the firing direction, to actuate the priming device.

15. A method as claimed in claim 14, wherein the movement of the printhead is a reciprocating vertical movement.

16. A method as claimed in claim 15, wherein the reciprocating vertical movement of the printhead is repeated a predetermined number of times.

17. A method as claimed in claim 14, wherein the printhead is mounted on a printhead carriage that may be displaced in a scan direction, and wherein the step of bringing a printhead in engagement with the priming device comprises displacing said printhead carriage to a priming position where the priming device is arranged.

* * * * *

UNITED STATES PATENT AND TRADEMARK OFFICE

CERTIFICATE OF CORRECTION

PATENT NO. : 7,360,863 B2
APPLICATION NO. : 11/154563
DATED : April 22, 2008
INVENTOR(S) : Zachary Ballard et al.

It is certified that error appears in the above-identified patent and that said Letters Patent is hereby corrected as shown below:

In column 3, line 39, delete “seating” and insert -- sealing --, therefor.

In column 3, line 41, delete “seating” and insert -- sealing --, therefor.

In column 4, line 60, in Claim 1, delete “directions” and insert -- direction --, therefor.

In column 5, line 13, in Claim 6, delete “seating” and insert -- sealing --, therefor.

Signed and Sealed this

Fifth Day of August, 2008

JON W. DUDAS
*Director of the United States Patent and Trademark Office*